US007571689B2

(12) United States Patent
Joe

(10) Patent No.: US 7,571,689 B2
(45) Date of Patent: Aug. 11, 2009

(54) CLUTCH STRUCTURE FOR PRESSER FOOT OF EMBROIDERY SEWING MACHINE

(75) Inventor: Sun Hwan Joe, Incheon-si (KR)

(73) Assignee: Sunstar Precision Co. Ltd., Incheon (KR)

( * ) Notice: Subject to any disclaimer, the term of this patent is extended or adjusted under 35 U.S.C. 154(b) by 0 days.

(21) Appl. No.: 12/122,913

(22) Filed: May 19, 2008

(65) Prior Publication Data

US 2008/0282953 A1 Nov. 20, 2008

(30) Foreign Application Priority Data

May 18, 2007 (KR) ..... 10-2007-0048772

(51) Int. Cl.
*D05B 29/02* (2006.01)
*D05B 29/00* (2006.01)

(52) U.S. Cl. ..... 112/236; 112/239

(58) Field of Classification Search ..... 112/236–240, 112/220, 284, 274
See application file for complete search history.

(56) References Cited

U.S. PATENT DOCUMENTS 4,716,846 A * 1/1988 Schneider et al. ..... 112/239
5,507,239 A * 4/1996 Fujii et al. ..... 112/274
5,590,614 A * 1/1997 Murata et al. ..... 112/237
5,615,628 A * 4/1997 Tajima et al. ..... 112/220
6,073,567 A * 6/2000 Aoki ..... 112/237
6,415,725 B1 * 7/2002 Yoshikazu ..... 112/237

* cited by examiner

*Primary Examiner*—Ismael Izaguirre

(57) ABSTRACT

A clutch structure for a presser foot in an embroidery sewing machine is provided. The clutch structure includes a guide member, to which the presser foot drive link is rotatably connected, and through which the needle bar guide shaft passes, a spring connecting member mounted on the outer circumference of the needle bar guide shaft and inside the guide member, a resilient member mounted on the outer periphery of the spring connecting member, and a pivot member mounted inside the guide member so as to be pivotable around the needle bar guide shaft within a certain angular range by the height adjusting mechanism and the resilient member. Upon a head-interval adjusting operation, the unnecessary driving of the presser foot is prevented, so that the occurrence of vibrations and noise as well as the unnecessary wear of a needle bar, a presser foot support, and a presser foot holder can be prevented.

6 Claims, 10 Drawing Sheets

CLUTCH STRUCTURE FOR PRESSER FOOT OF EMBROIDERY SEWING MACHINE

BACKGROUND OF THE INVENTION

1. Field of the Invention

The present invention relates to an embroidery sewing machine, and more particularly, to a clutch structure for a presser foot in an embroidery sewing machine, which upon a head-interval adjusting operation, can prevent unnecessary driving of a presser foot (a cloth pressing member), thereby preemptively avoiding the occurrence of vibration and noise caused by the unnecessary driving of the presser foot, as well as unnecessary wear of a needle bar installed in a needle bar support case so as to be able to move up and down, a presser foot support, and a presser foot holder.

2. Description of the Related Art

Generally, an embroidery sewing machine is a biaxial positioning control machine, in which an embroidery stitch frame for fixing fabric undergoes horizontal motion in x-axis and y-axis directions while a needle bar moves up and down.

Since such an embroidery sewing machine does needlework while the embroidery stitch frame, holding the fabric, is moved in x-axis and y-axis directions, the precision of movement of the embroidery frame, and the uniformity of speed thereof, have a close relationship to the quality of an embroidered pattern.

Accordingly, a drive source of the embroidery sewing machine, which transfers the needle bar in vertical directions and the embroidery stitch frame in the x-axis and y-axis directions, is generally implemented with a servo motor, which can be precisely controlled, or a motor, the position of which can be controlled.

FIG. 1 is a side elevation view illustrating the drive structure for a presser foot of a conventional embroidery sewing machine in the mounted position, FIG. 2 is a perspective view illustrating the drive structure for the presser foot shown in FIG. 1, in which a height adjustment mechanism is installed, and FIG. 3 is an enlarged perspective view of part "A" of FIG. 2.

As shown in FIGS. 1 and 2, when an upper shaft 104 rotates, a presser foot drive cam 112, coupled to the upper shaft 104, rotates in cooperation therewith. In response to the rotation of the presser foot drive cam 112, a presser foot drive cam transmission member 110 vertically reciprocates according to the amount of eccentricity of the presser foot drive cam 112.

As the presser foot drive cam transmission member 110 moves vertically, a presser foot drive lever 114, connected to the lower end of the presser foot drive cam transmission member 110, vertically pivots around a certain pivot point. In cooperation with this action, a presser foot drive block 118, connected to the presser foot drive lever 114 via a presser foot drive link 116, vertically reciprocates on a needle bar guide shaft 130.

As the presser foot drive block 118 moves vertically, a presser foot holder 118*a*, fastened to a presser foot holder gripper (not shown), which is housed inside the presser foot drive block 118, vertically moves in cooperation with the presser foot drive block 118. In cooperation with this action, a presser foot assembly (not shown), fastened to the presser foot holder 118*a*, also moves vertically. Furthermore, a needle bar 132, connected to the bottom of the presser foot holder 118*a*, vertically moves inside a sewing head (not shown), and a presser foot 128, coupled to the lower end of a presser foot support 124, also vertically operates.

Meanwhile, in the case where a height adjustment mechanism is installed in the drive structure for the presser foot, the pivot point 114*a* of the presser foot drive lever 114 can be moved up and down.

That is, as shown in FIGS. 2 and 3, the height adjustment mechanism acts to displace the pivot point 114*a* of the presser foot drive lever 114 in a predetermined direction, thereby adjusting the upper dead point and the lower dead point of the presser foot 128, and includes a drive motor 140, a drive pulley 142, operably coupled to the drive motor 140, a follower pulley 143, which is connected to and rotates following the drive pulley 142, and an eccentric member 145, which displaces the pivot point 114*a* of the presser foot drive lever 114 using the driving force of the drive motor 140.

The eccentric member 145 is connected, at a meshing protrusion 145*c* protruding from the center of one side thereof to realize a predetermined amount of eccentricity, to the pivot point 114*a* of the presser drive lever 114, so that the pivot point 114*a* of the presser foot drive lever 114 can be displaced upward or downward by the eccentric member 145 connected to the following pulley 143.

The position of the upper and lower dead points of the presser foot 128 can be easily and correctly controlled, since the pivot point 114*a* of the presser foot drive lever 114 can be displaced upward or downward through the control of the drive motor 140. Accordingly, this makes it possible to automatically control a sewing operation in response to the thickness of a sheet of cloth to be sewn, and to adjust the height of the presser foot 128 by displacing the pivot point 114 of the presser foot drive lever 114. In a sewing operation, when a sheet of cloth to be sewn is relatively thick, the height adjustment mechanism is operated to raise the height of the lower dead point of the presser foot 128. When the sheet of cloth to be sewn is relatively thin, the height adjustment mechanism is operated to lower the height of the lower dead point of the presser foot 128.

Meanwhile, during the above operation, the presser foot holder 118*a* is fixed to the presser foot drive block 118, so that both are operated together upon the driving of the needle bar. This action occurs similarly to a non-embroidery sewing head in an head-interval adjusting operation conducted such that when the lateral width of the embroidery is larger than the interval of the sewing head, the action of an odd- or even-numbered needle bar 132 of the sewing head must be stopped, or the driving of the needle bar 132 must be interrupted for a long period and repeatedly, which is problematic. Further, there is a problem in that upon such an operation, as the presser foot 128 is driven in the non-embroidery sewing head, vibrations and noise occur inside the sewing arm 102 due to the unnecessary driving.

SUMMARY OF THE INVENTION

The present invention has been made to solve the foregoing problems with the prior art, and therefore the present invention provides a clutch structure for a presser foot in an embroidery sewing machine which can relieve vibrations and noise by preventing unnecessary driving of a presser foot.

The present invention also provides a clutch structure for a presser foot in an embroidery sewing machine which can improve durability through preemptive prevention of unnecessary friction with a needle bar support case.

According to an aspect of the present invention, there is provided a clutch structure for a presser foot in an embroidery sewing machine, wherein, as an upper shaft rotates, a presser foot drive cam rotates, with the result that a presser foot drive lever having a presser foot drive link pivots around a certain pivot point, which is moved vertically by a height adjusting mechanism for the presser foot, a presser foot drive block connected to the presser foot drive link vertically reciprocates on a needle bar guide shaft, and a presser foot moves vertically in cooperation with the vertical movement of a presser foot holder fastened to the presser foot drive block, the clutch structure comprising: a guide member, to which the presser foot drive link is rotatably connected, and through which the needle bar guide shaft passes; a spring connecting member mounted on the outer circumference of the needle bar guide shaft and inside the guide member; a resilient member mounted on the outer periphery of the spring connecting member; and a pivot member mounted inside the guide member so as to be pivotable around the needle bar guide shaft within a certain angular range by the height adjusting mechanism and the resilient member.

In the clutch structure of the invention, the guide member may have rectangular upper and lower portions each having a through-hole, through which the needle bar guide shaft passes, and a connecting portion connecting the upper and lower portions.

In the clutch structure of the invention, the spring connecting member may have an extension integrally protruding from one side of its outer circumference, the extension being provided with a through-hole through which one end of the resilient member is inserted and fixed.

In the clutch structure of the invention, the resilient member may be a coil spring.

In the clutch structure of the invention, the pivot member may include a housing having a through-hole in a length direction thereof, an abutting protrusion attached to one end of an outer face of the housing, and first and second engaging protrusions attached to the other end of the outer face of the housing so as to be engaged with the presser foot holder.

In the clutch structure of the invention, the first engaging protrusion may have an inclined portion, an upper face of which is inclined at a certain angle, and the second engaging protrusion may be of a rectangular shape.

BRIEF DESCRIPTION OF THE DRAWINGS

The above and other objects, features and other advantages of the present invention will be more clearly understood from the following detailed description, taken in conjunction with the accompanying drawings, in which.

DETAILED DESCRIPTION OF THE INVENTION

Figure 1:
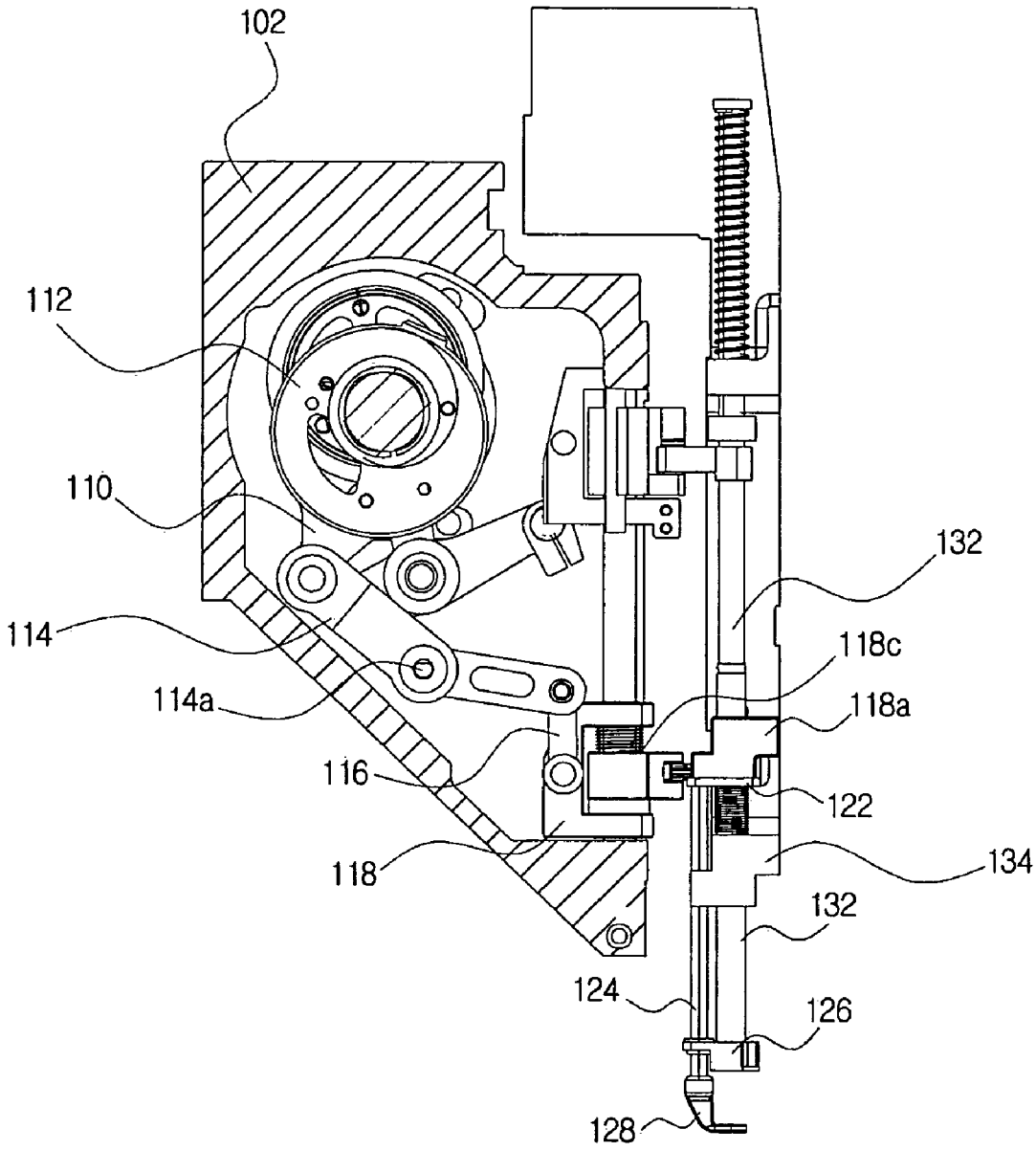
FIG. 1 is a side elevation view illustrating the drive structure for a presser foot of a conventional embroidery sewing machine in the mounted position.

Hereinafter, a clutch structure for a presser foot in an embroidery sewing machine according to the present invention will be described more fully with reference to the accompanying drawings, wherein like reference numerals refer to like elements.

Figure 4:
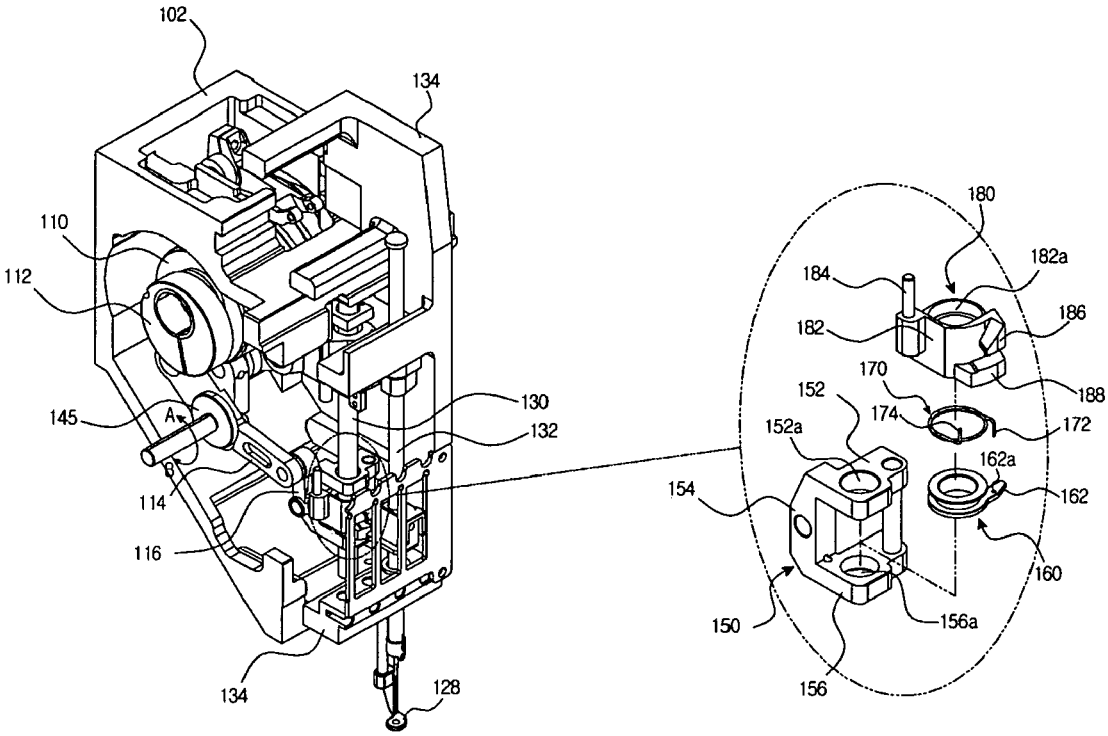
FIG. 4 is a perspective view and a partially enlarged exploded perspective view illustrating a clutch structure for a presser foot in an embroidery sewing machine according to the present invention, in the mounted position.
Figure 5A:
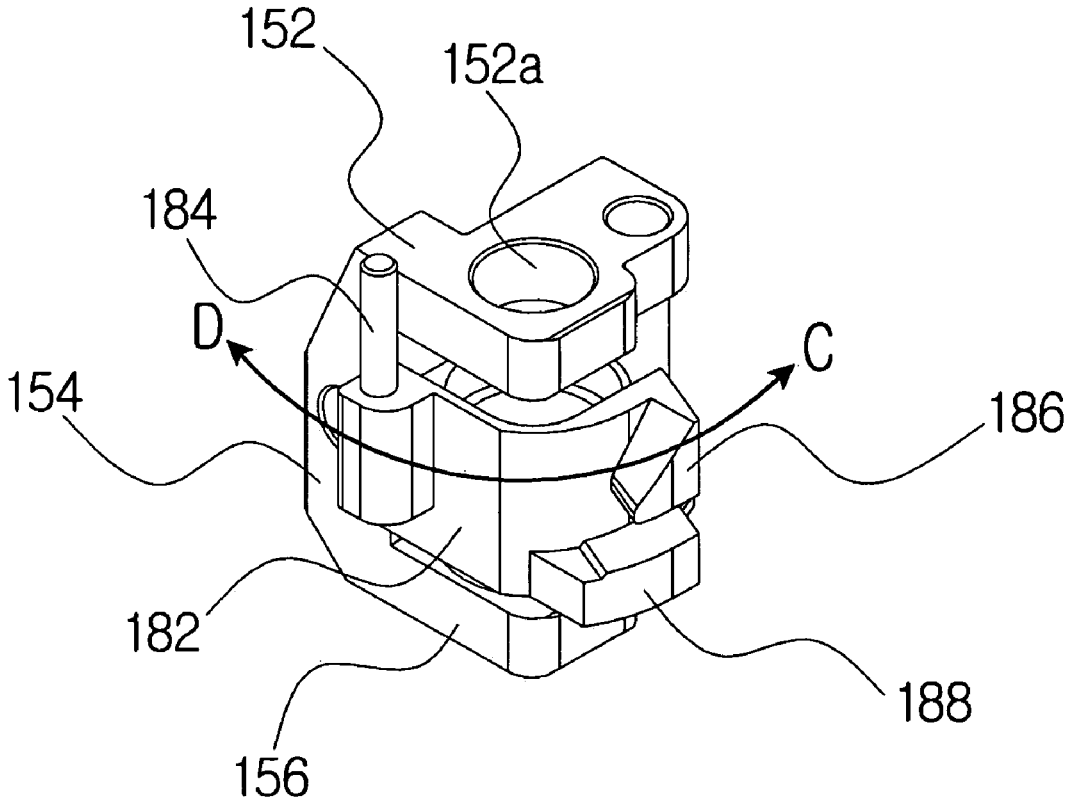
FIG. 5A is a perspective view illustrating the assembled clutch structure for the presser foot of the embroidery sewing machine according to the present invention, seen from one direction.
Figure 5B:
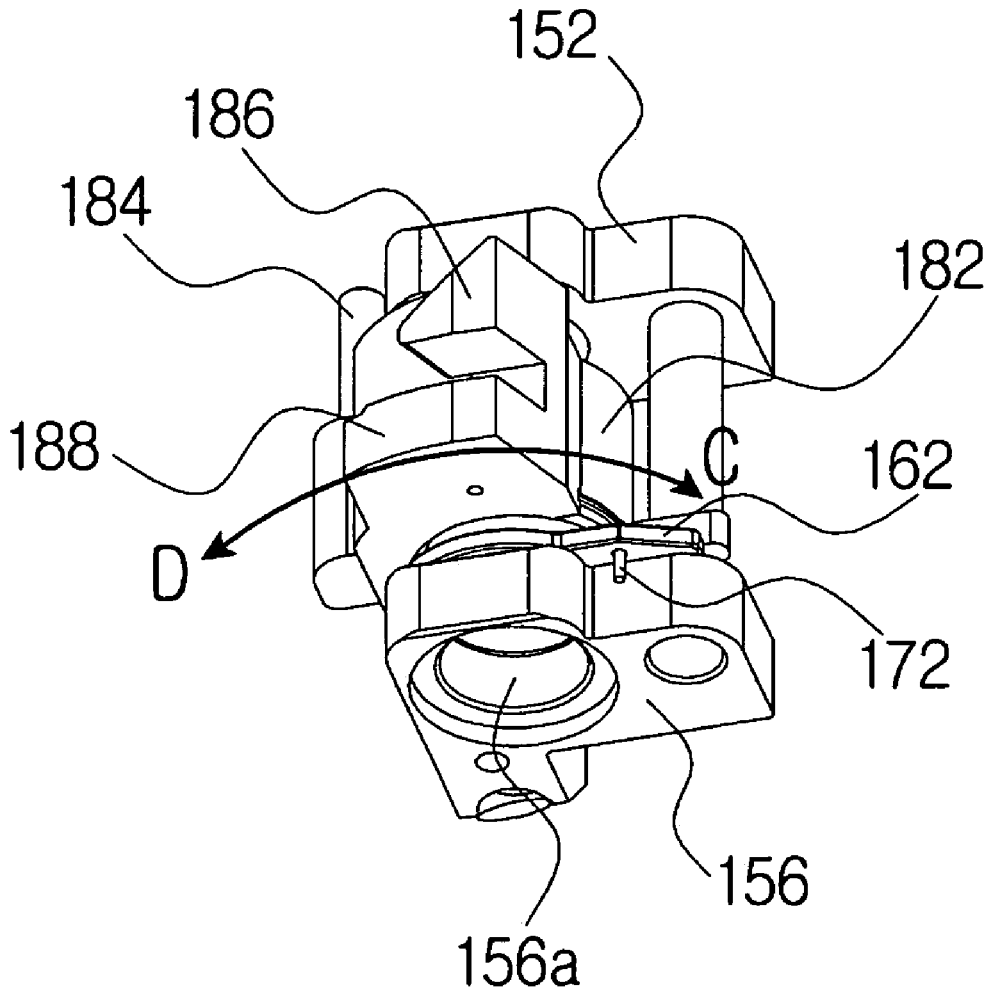
FIG. 5B is a perspective view illustrating the assembled clutch structure for the presser foot of the embroidery sewing machine according to the present invention, seen from the other direction.

FIG. 4 is a perspective view and a partially enlarged exploded perspective view illustrating a clutch structure for a presser foot in an embroidery sewing machine according to the present invention, in the mounted position, FIG. 5A is a perspective view illustrating the assembled clutch structure for the presser foot of the embroidery sewing machine according to the present invention, seen from one direction, and FIG. 5B is a perspective view illustrating the assembled clutch structure for the presser foot of the embroidery sewing machine according to the present invention, seen from the other direction.

Referring to these drawings, the clutch structure for the presser foot of the embroidery sewing machine according to the present invention generally includes a guide member 150, a spring connecting member 160 mounted inside the guide member 150, a resilient member 170 mounted on the outer periphery of the spring connecting member 160, and a pivot member 180 mounted inside the guide member 150 so as to be pivotable using the spring connecting member 160 and the resilient member 170.

The guide member 150 generally has a sectional shape like a 'C', as shown in FIG. 4, such that rectangular upper and lower portions 152 and 156 are connected together through a connecting portion 154, and such that the upper and lower portions 152 and 156 are respectively provided with upper and lower through-holes 152*a* and 156*a*, through which a needle bar guide shaft 130 passes.

The guide member 150 is rotatably coupled with a presser foot drive link 116 using a pin (not shown), through one side thereof, i.e., the connecting portion 154. Thus, as a presser foot drive lever 114 vertically pivots at a certain angle around a pivot point 114*a*, the connecting section between the presser foot drive link 116 and the presser foot drive lever 114 pivots back and forth at a certain angle around the pin-connecting section.

The spring connecting member 160, as shown in FIG. 4, has an extension 162 which has a specified shape and thickness and integrally protrudes from one side of its outer circumference. The extension is provided with a through-hole 162*a*, through which one end 172 of the resilient member 170 is inserted. The spring connecting member is mounted on the outer circumference of the needle bar guide shaft 130 inside the guide member 150.

The resilient member 170, as shown in FIG. 4, is a coil spring, which is mounted on the outer periphery of the spring connecting member 160, wherein one end 172 is inserted into and fixed to the through-hole 162*a* in the spring connecting member 160, and the other end 174 is partially inserted into and fixed to the connecting portion 154 of the guide member 150 in a length direction thereof.

The pivot member 180 is mounted inside the guide member 150 so as to be pivotable around the needle bar guide shaft 130. The pivot member, as shown in FIG. 4, includes a housing 182 having, at its center, a through-hole 182*a*, through which the needle bar guide shaft 130 passes, an abutting protrusion 184 protruding from one end of an outer face of the housing 182 and abutting the connecting section between the presser foot drive link 116 and the presser foot drive lever 114, and first and second engaging protrusions 186 and 188, attached to the other end of the outer face of the housing 182 so as to be engaged with a presser foot holder 118*a*. The first engaging protrusion 186 has an inclined portion, an upper face of which is inclined at about 45°, and the second engaging protrusion 188 has a rectangular shape.

Now the operation of the present invention having the above construction will be described.

Figure 2:
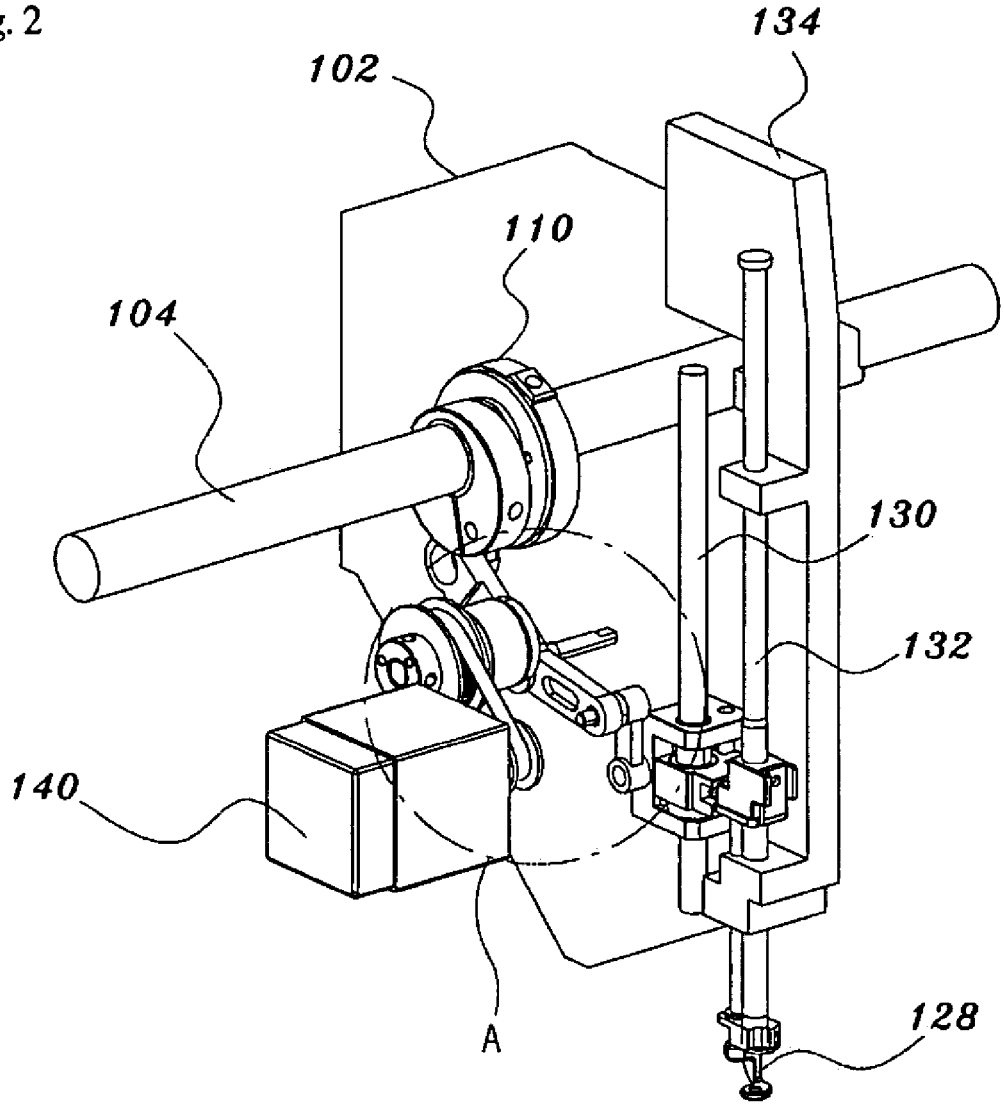
FIG. 2 is a perspective view illustrating the drive structure for the presser foot shown in FIG. 1, in which a height adjustment mechanism is installed.
Figure 3:
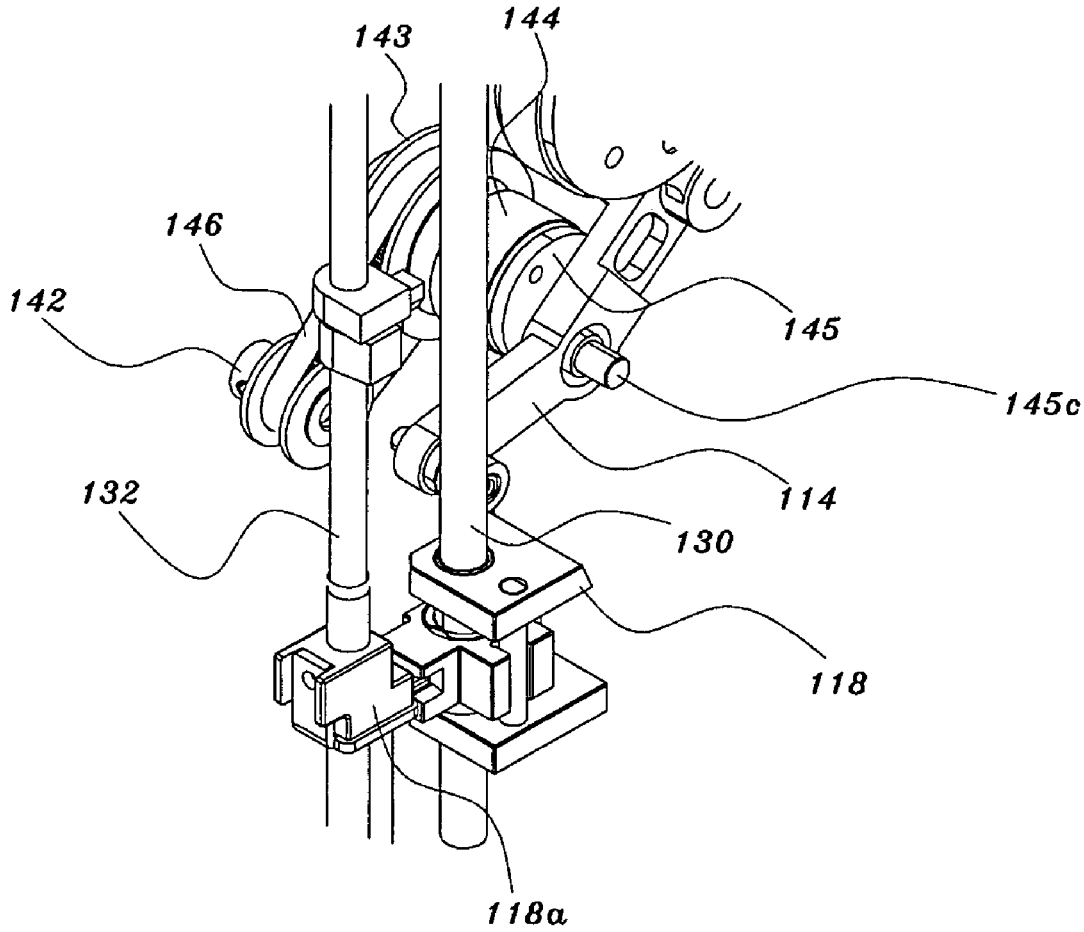
FIG. 3 is an enlarged perspective view of part "A" of FIG. 2.

As described before and shown in FIGS. 1 to 3, when an upper shaft 104 is rotated by the rotating drive force of an upper shaft motor (not shown), a presser foot drive cam 112, coupled to the upper shaft 104, rotates in cooperation therewith. In response to the rotation of the presser foot drive cam 112, a presser foot drive cam transmission member 110 vertically reciprocates according to the amount of eccentricity of the presser foot drive cam 112.

As the presser foot drive cam transmission member 110 moves vertically, the presser foot drive lever 114, connected to the presser foot drive cam transmission member 110, vertically pivots around a certain pivot point 114*a*. In cooperation with this action, the guide member (150 in FIG. 4), connected to the presser foot drive lever 114 via the presser foot drive link 116, vertically reciprocates on the needle bar guide shaft 130.

Figure 6:
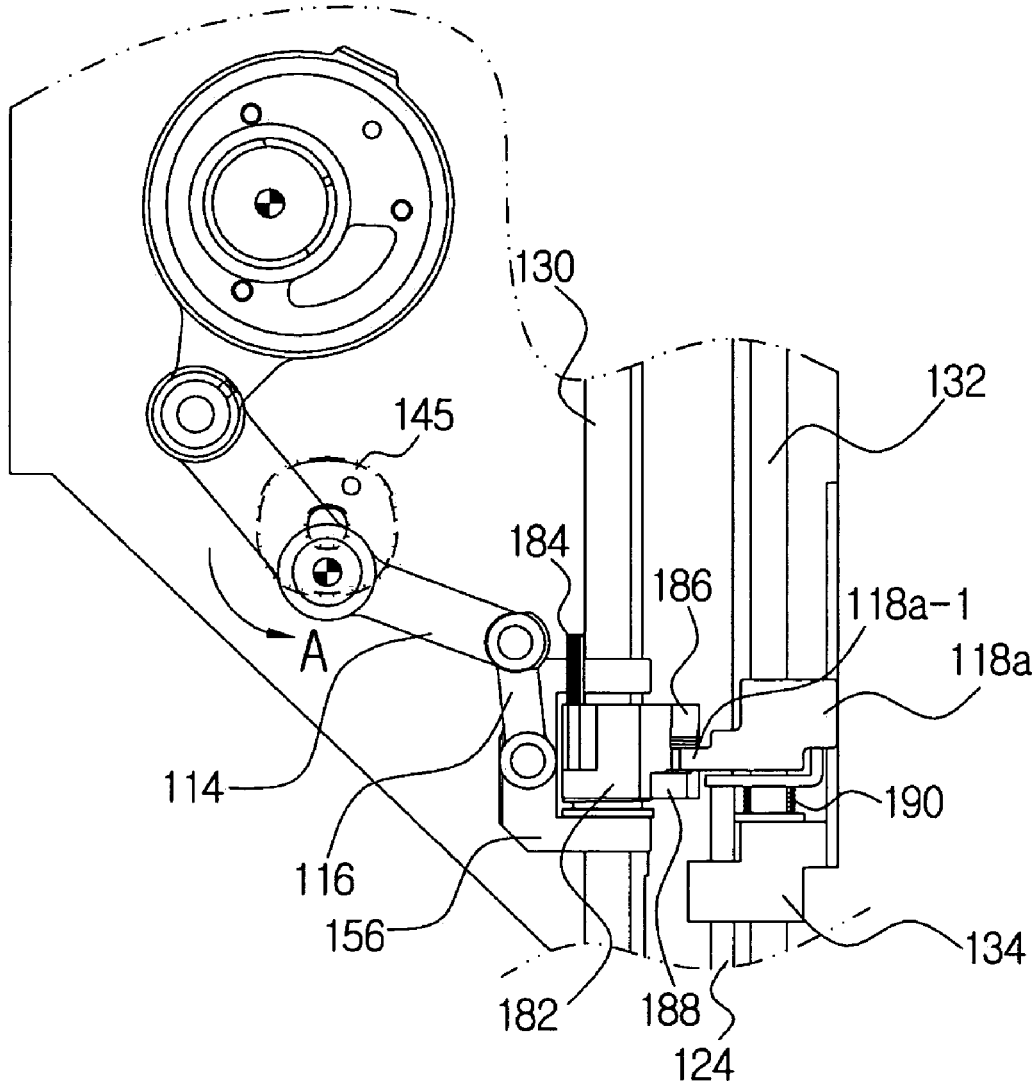
FIGS. 6 to 9 are side views illustrating the operating state of the clutch structure for the presser foot of the embroidery sewing machine according to the present invention.

FIGS. 6 to 9 are side views illustrating the operating state of the present invention, in which a height adjusting mechanism for a presser foot is not illustrated. FIG. 6 illustrates the state where the presser foot drive lever 114 is not yet in contact with the abutting protrusion 184, wherein the protrusion 118*a*-1 of the presser foot holder 118*a* is inserted between the first and second engaging protrusions 186 and 188, and wherein a spring 190 is in a compressed state.

Figure 7:
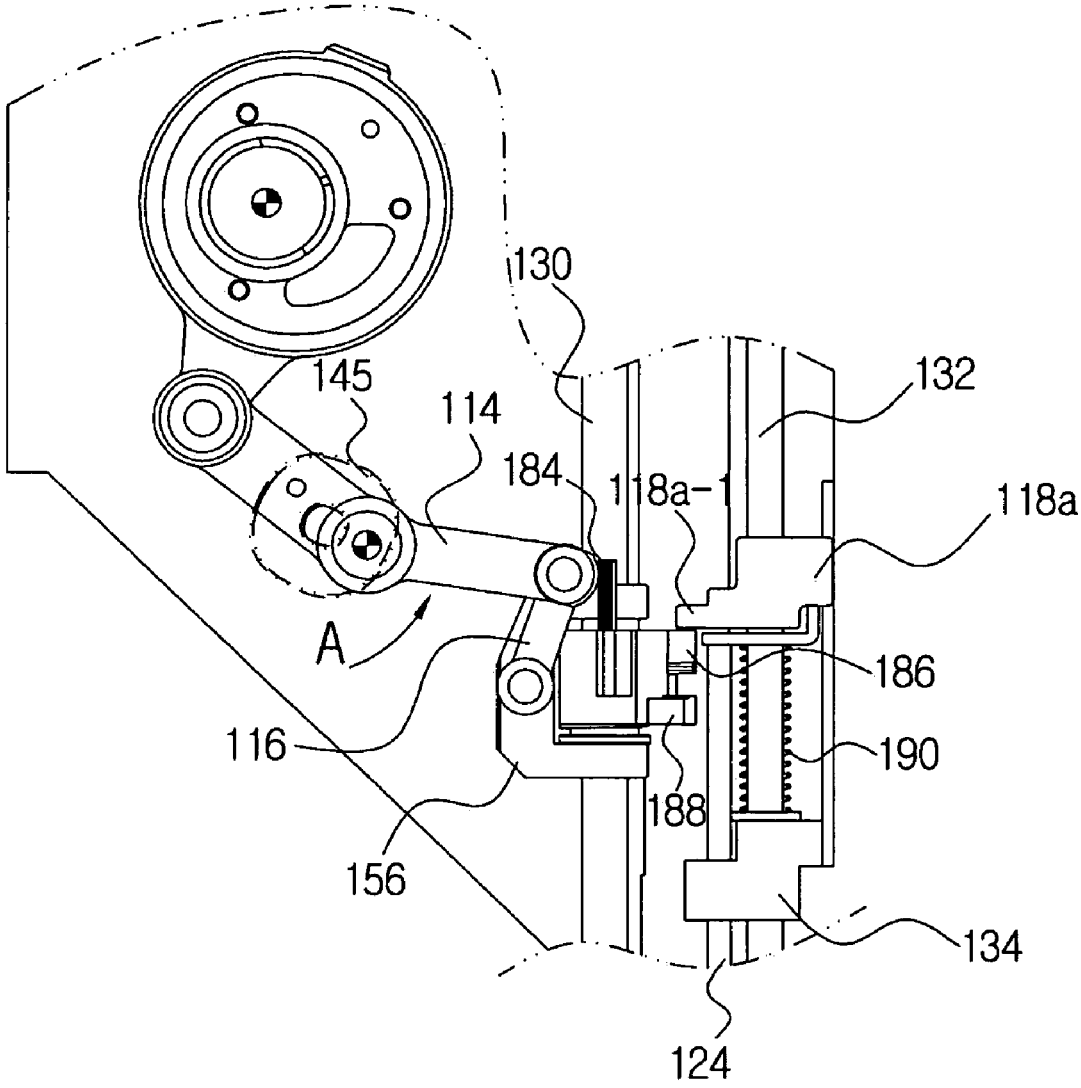
Figure 8:
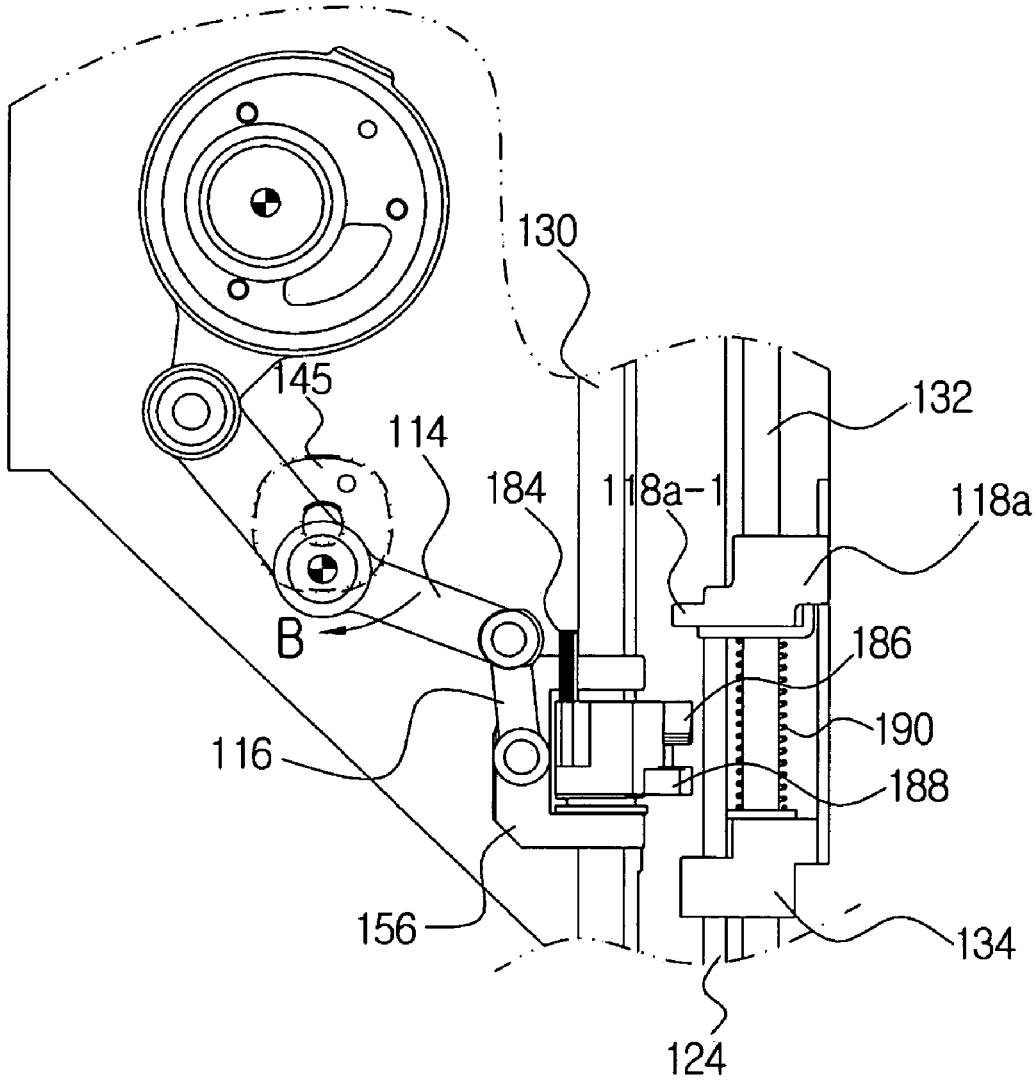

Meanwhile, when a person tries to stop the unnecessary driving of a presser foot of a non-embroidery sewing head by a head-interval adjusting operation, the eccentric member 145 is rotated counterclockwise (direction A) at a certain angle through the operation of a drive motor 140 of the height adjusting mechanism for the presser foot to thereby move the pivot point 114*a* of the presser foot drive lever 114 upwards. Then, the connecting section between the presser foot drive link 116 and the presser foot drive lever 114 comes into contact with the abutting protrusion 184 of the pivot member 180. Then, the abutting protrusion 184 is thus rotated in one direction C (see FIGS. 5A and 5B), with the result that, as shown in FIG. 7, the pivot member 180 pivots around the needle bar guide shaft 130.

At the same time, the protrusion 118*a*-1 of the presser foot holder 118*a* is detached from the space between the first and second engaging protrusions 186 and 188 of the pivot member 180. At this time, the spring 190 fully extends to upwardly move the presser foot holder 118*a*, and the drive motor 140 again rotates the eccentric member 145 in a clockwise direction (direction B) (see FIG. 8), to thereby move the pivot point 114*a* of the presser foot drive lever 114 down to its original position. Concurrently, the pivot member 180 is also rotated in one direction D to its original position due to the resilient force of the resilient member 170 (see FIGS. 5A and 5B).

Through such an operation, the presser foot holder 118*a* is detached from the pivot member 180, so that the drive force transmitted to the presser foot 128 is cut off, to thereby prevent the driving of the presser foot 128 of the non-embroidery sewing head.

Figure 9:
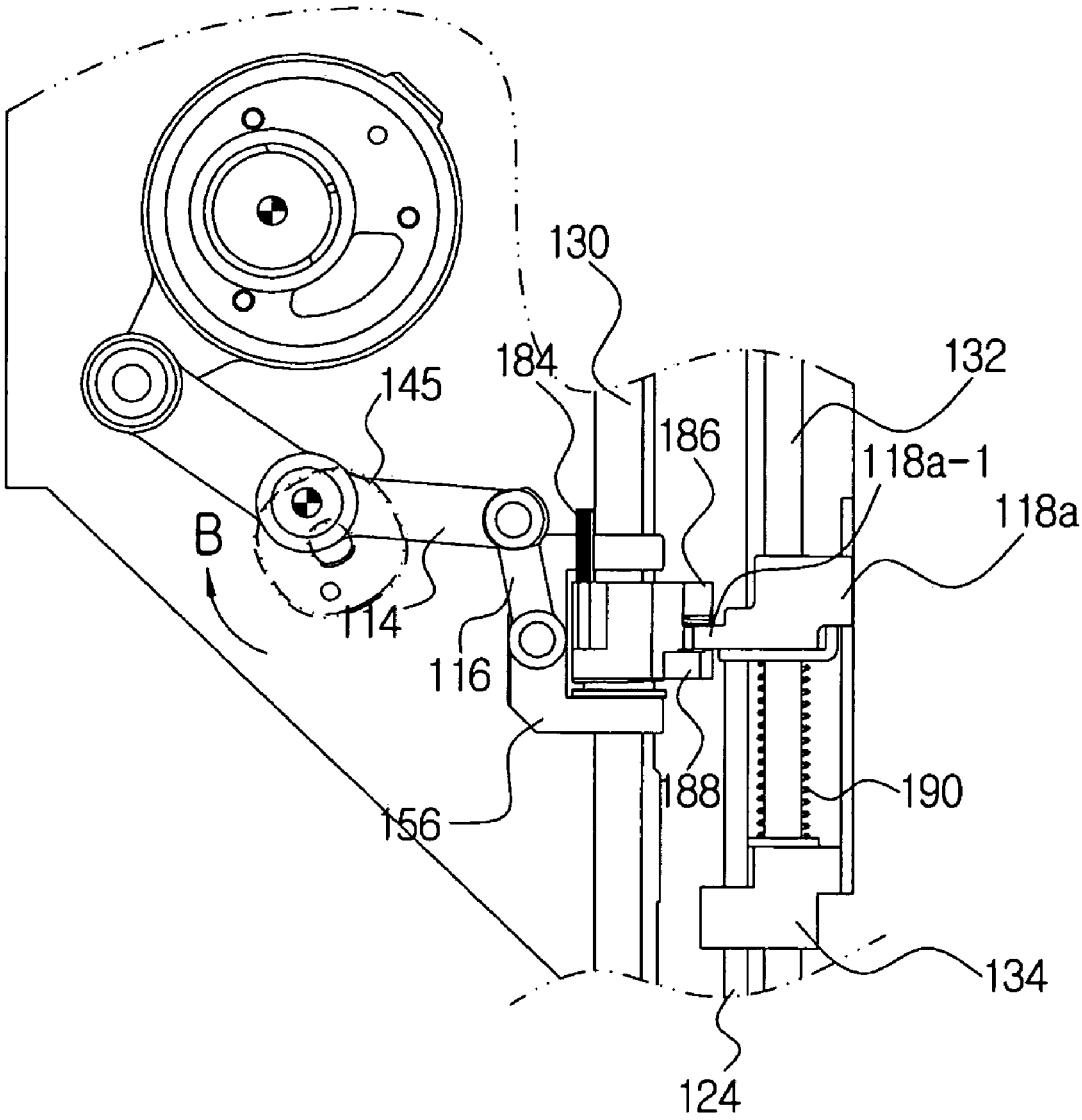

Meanwhile, if a person tries to connect the drive force in order to resume operation of the presser foot of the non-embroidery sewing head, which has been in an interrupted state, as shown in FIG. 9, the eccentric member 145 is rotated in a clockwise direction (direction B) using the operation of the drive motor 140 to thereby move the pivot point 114*a* of the presser foot drive lever 114 upwards. Then, the guide member 150 moves upwards along the outer circumference of the needle bar guide shaft 130 to the position where the presser foot holder 118*a* is on standby. At this time, the protrusion 118*a*-1 of the presser foot holder 118*a* comes into contact with the first engaging protrusion 186 and concurrently moves along the inclined face thereof to the space between the first and second engaging protrusions 186 and 188, thereby coming to the power-connection state where the drive force of the upper shaft 104 for driving the presser foot 128 can be transmitted.

In such a power-connection state, if the drive motor 140 is operated again to rotate the eccentric member 145 in a counterclockwise direction (direction A), the pivot point 114*a* of the presser foot drive lever 114 moves downward so that, as shown in FIG. 6, the presser foot 128 moves to its operating position. Herein, the guide member 150 moves down along the outer circumference of the needle bar guide shaft 130, and at the same time the presser foot holder 118*a* moves downward together with the pivot member 180 without being detached from the pivot member 180, so that the presser foot 128, coupled to the lower end of the presser foot support 124, also moves to its operating position.

According to the present invention as described above, the presser foot holder can be separated from the guide member mounted on the needle bar guide shaft, the unnecessary driving of the presser foot can be prevented in the non-embroidery sewing head during the head-interval adjusting operation, during which the needle bar must stop operating, or can be continuously interrupted from driving for a long time.

Further, since the unnecessary driving of the presser foot is preemptively prevented, the occurrence of vibration and noise caused by such unnecessary drive of the presser foot can be preemptively prevented.

Furthermore, since the unnecessary driving of the presser foot is prevented, the unnecessary wear of the needle bar, installed in the needle bar support case so as to be able to move up and down, the presser foot support, and the presser foot holder can also be preemptively prevented.

While the clutch structure for the presser foot of the embroidery sewing machine of the present invention has been described with reference to the particular illustrative embodiments and the accompanying drawings, it is not to be limited thereto. It is to be appreciated that those skilled in the art can substitute, change or modify the embodiments in various forms without departing from the scope and spirit of the present invention.

What is claimed is:

1. A clutch structure for a presser foot in an embroidery sewing machine, in which, as an upper shaft rotates, a presser foot drive cam rotates, with the result that a presser foot drive lever having a presser foot drive link pivots around a certain pivot point, which is moved vertically by a height adjusting mechanism for the presser foot, a presser foot drive block connected to the presser foot drive link vertically reciprocates on a needle bar guide shaft, and a presser foot moves vertically in cooperation with vertical movement of a presser foot holder fastened to the presser foot drive block, the clutch structure comprising:

a guide member, to which the presser foot drive link is rotatably connected, and through which the needle bar guide shaft passes;

a spring connecting member mounted on the outer circumference of the needle bar guide shaft and inside the guide member;

a resilient member mounted on an outer periphery of the spring connecting member; and a pivot member mounted inside the guide member so as to be pivotable around the needle bar guide shaft within a certain angular range by the height adjusting mechanism and the resilient member.

2. The clutch structure according to claim 1, wherein the guide member has rectangular upper and lower portions, each having a through-hole, through which the needle bar guide shaft passes, and a connecting portion connecting the upper and lower portions.

3. The clutch structure according to claim 1, wherein the spring connecting member has an extension integrally protruding from one side of its outer circumference, the extension being provided with a through-hole through which one end of the resilient member is inserted and fixed.

4. The clutch structure according to claim 1, wherein the resilient member comprises a coil spring.

5. The clutch structure according to claim 1, wherein the pivot member includes a housing having a through-hole along a length direction thereof, an abutting protrusion attached to one end of an outer face of the housing, and first and second engaging protrusions attached to a remaining end of the outer face of the housing so as to be engaged with the presser foot holder.

6. The clutch structure according to claim 5, wherein the first engaging protrusion has an inclined portion, an upper face of which is inclined at a certain angle, and wherein the second engaging protrusion has a rectangular shape.

* * * * *